US010836201B2

(12) United States Patent
Falzone

(10) Patent No.: US 10,836,201 B2
(45) Date of Patent: Nov. 17, 2020

(54) OFFICE SUPPLY ORGANIZER HAVING MULTIPLE FOLD CONFIGURATIONS

(71) Applicant: Diane Elisa Falzone, Staten Island, NY (US)

(72) Inventor: Diane Elisa Falzone, Staten Island, NY (US)

( * ) Notice: Subject to any disclaimer, the term of this patent is extended or adjusted under 35 U.S.C. 154(b) by 0 days.

(21) Appl. No.: 16/206,243

(22) Filed: Nov. 30, 2018

(65) Prior Publication Data

US 2019/0100051 A1 Apr. 4, 2019

Related U.S. Application Data

(63) Continuation-in-part of application No. 14/465,262, filed on Aug. 21, 2014, now abandoned.

(60) Provisional application No. 61/959,423, filed on Aug. 23, 2013.

(51) Int. Cl.

| | |
|---|---|
| ***B42F 7/08*** | (2006.01) |
| ***A45C 7/00*** | (2006.01) |
| ***A45C 13/00*** | (2006.01) |

(52) U.S. Cl.

CPC ..... *B42F 7/08* (2013.01); *A45C 7/0036* (2013.01); *A45C 7/0054* (2013.01); *A45C 7/0077* (2013.01); *A45C 7/0095* (2013.01); *A45C 13/005* (2013.01); *A45C 2007/0004* (2013.01); *B42P 2201/12* (2013.01); *B42P 2241/04* (2013.01)

(58) Field of Classification Search

CPC ..... B42F 7/08; B42P 2201/12; B42P 2241/04
USPC ..... 281/20; 402/73, 80 P
See application file for complete search history.

(56) References Cited

U.S. PATENT DOCUMENTS

2010/0326865 A1* 12/2010 Maistrellis ..... B42F 21/00 206/459.5
2012/0091018 A1* 4/2012 Bock ..... B42F 7/065 206/307

* cited by examiner

*Primary Examiner* — Justin V Lewis
(74) *Attorney, Agent, or Firm* — Dunlap Bennett & Ludwig, PLLC

(57) ABSTRACT

An office supply organizer, for providing a compact housing for holding various office supply items in a secure environment. The organizer includes a main body platform substantially having a shape of a quadrangle having four peripheral edges, an underside and a top side. The main body platform further includes four distinct quadrants divided by seams. At least one pocket is attached to the top side of at least one of the four adjacent quadrants. The main body platform is foldable in a first direction and is reversible, and foldable in a second direction. At least one a closure is coupled to the main body platform and is configured to retain the main body platform in at least one of a first folded configuration and a second folded configuration.

10 Claims, 5 Drawing Sheets

OFFICE SUPPLY ORGANIZER HAVING MULTIPLE FOLD CONFIGURATIONS

CROSS-REFERENCE TO RELATED APPLICATION

This application is a continuation in part of U.S. nonprovisional application Ser. No. 14/465,262, filed Aug. 21, 2014, and claims the benefit of priority to U.S. provisional application No. 61/959,423, filed Aug. 23, 2013, the contents of which are herein incorporated by reference.

BACKGROUND OF THE INVENTION

The present invention relates to an organizer and, more particularly, to an office supply organizer having multiple fold configurations.

Businessmen and women and students often carry office and school supplies to and from work areas and school. Office and school supplies typically comprise of papers, folders, electronic devices, and the like. Currently, briefcases and backpacks are used to carry the above mentioned office and school supplies. However, briefcases and backpacks are not equipped to organize the office and school supplies. The school and office supplies are haphazardly carried within the briefcase and backpack, making it difficult to quickly access them.

As can be seen, there is a need for an office supply organizer having multiple fold configurations

SUMMARY OF THE INVENTION

In one aspect of the present invention, an office supply organizer, for providing a compact housing for holding various office supply items in a secure environment, comprises: a main body platform substantially having a shape of a quadrangle having four peripheral edges, an underside and a top side; and at least one a closure coupled to the main body platform and configured to retain the main body platform in at least one of a first folded configuration and a second folded configuration, wherein the main body platform further comprises four distinct quadrants divided by seams, each quadrant having four quadrant peripheral edges, each quadrant being adjacent to each other, wherein each quadrant is foldable relative to adjacent quadrants about the seams, the main body platform further comprises at least one pocket attached to the top side of at least one of the four adjacent quadrants, and the main body platform folds along the seams in the first folded configuration and the second folded configuration, wherein the first folded configuration comprises the main body platform initially folding inwards towards the top side and then folding again to be one-quarter the dimension of the unfolded main body platform and the second folded configuration comprises the main body platform initially folding outwards towards the underside and then folding again to be one-quarter the dimension of the unfolded main body platform, wherein the at least one pocket is exposed in the second folded configuration.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
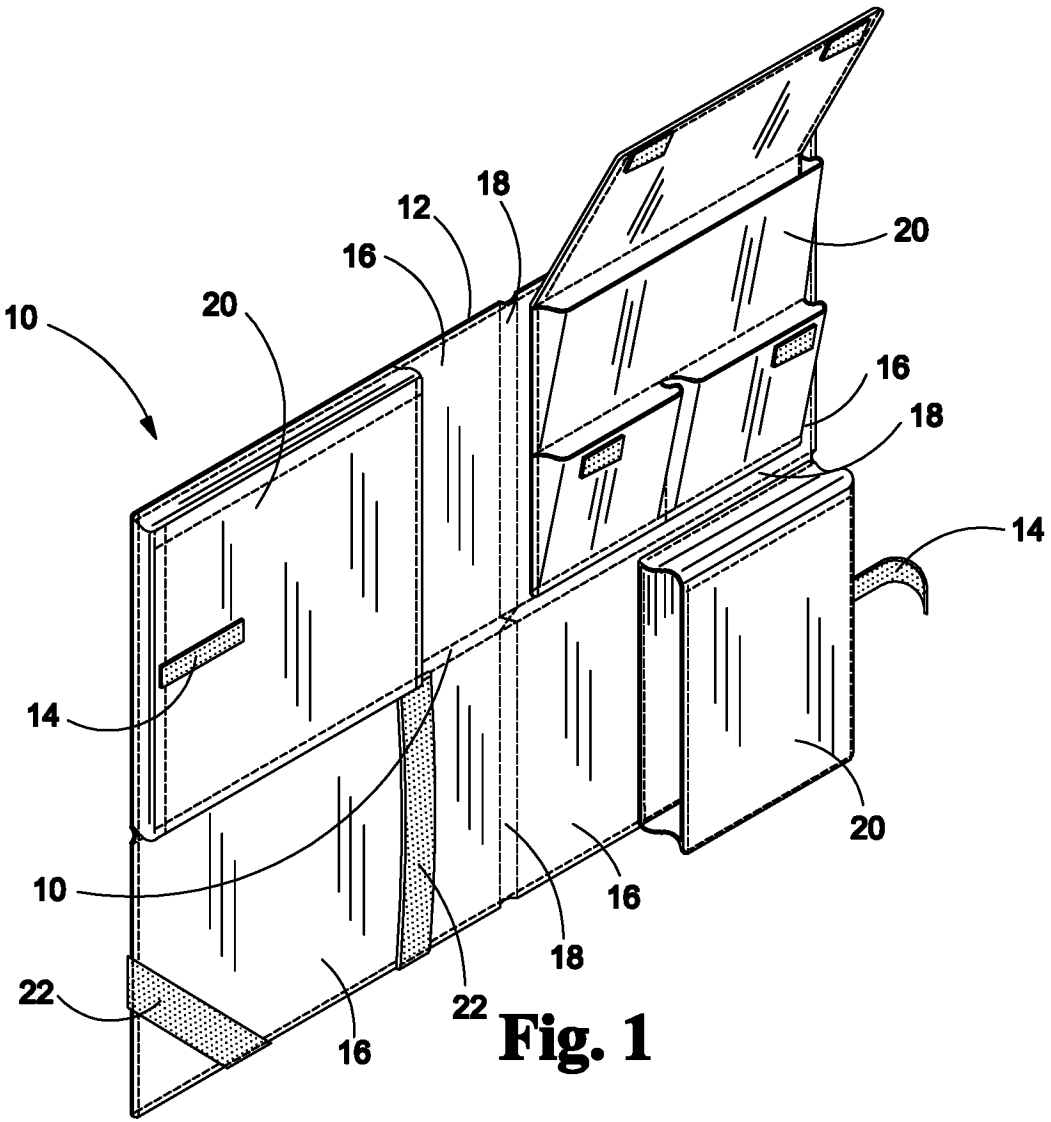
FIG. 1 is a front perspective view of an embodiment of the present invention in an open configuration.
Figure 2:
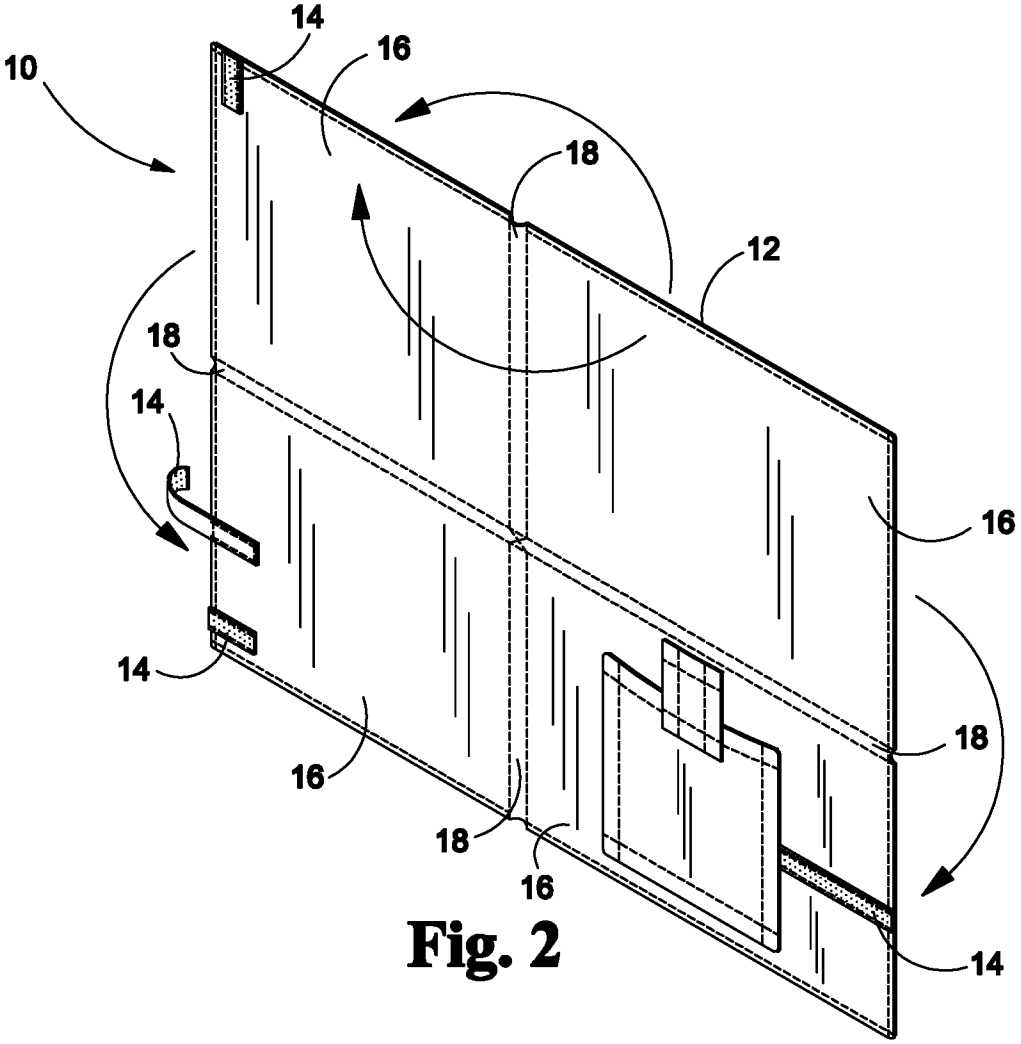
FIG. 2 is a rear perspective view of an embodiment of the present invention in an open configuration.
Figure 3:
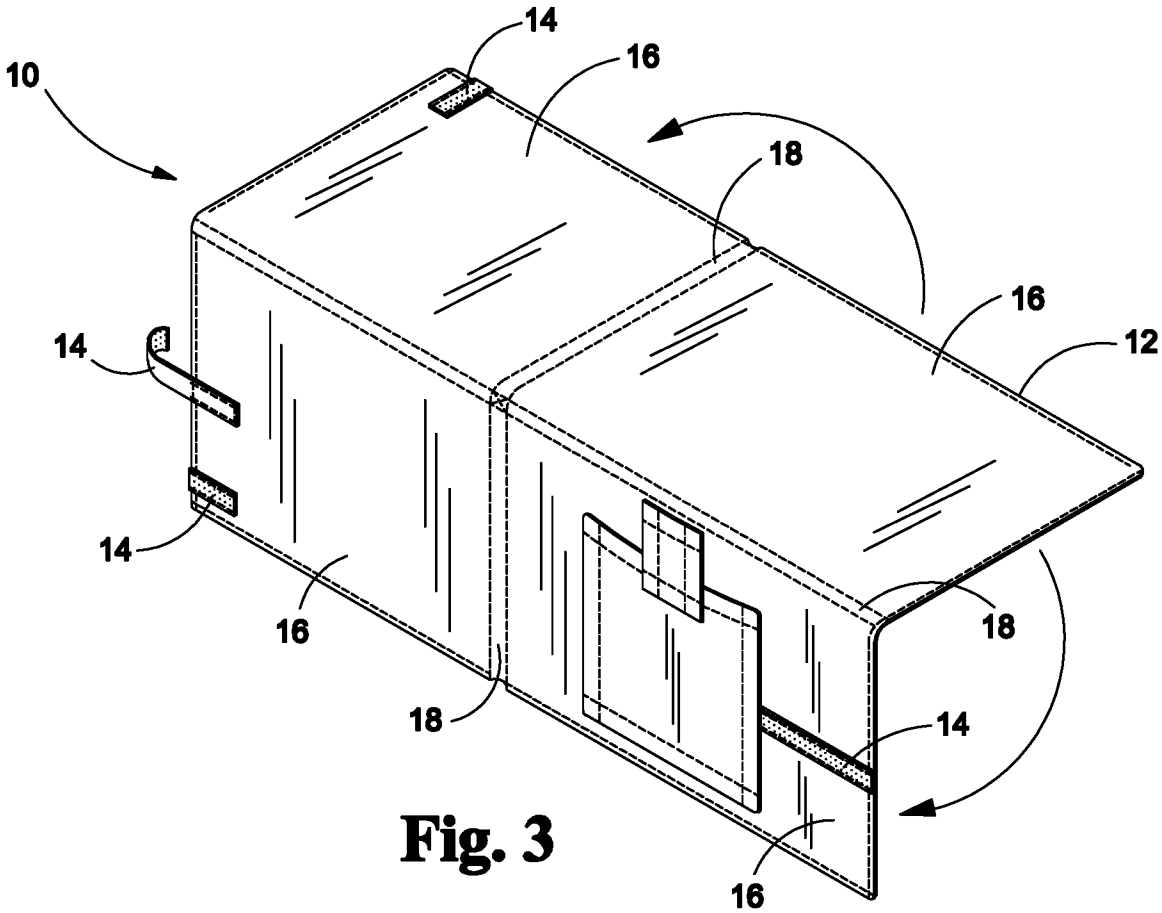
FIG. 3 is a perspective view of an embodiment of the present invention in a partially folded configuration.
Figure 5:
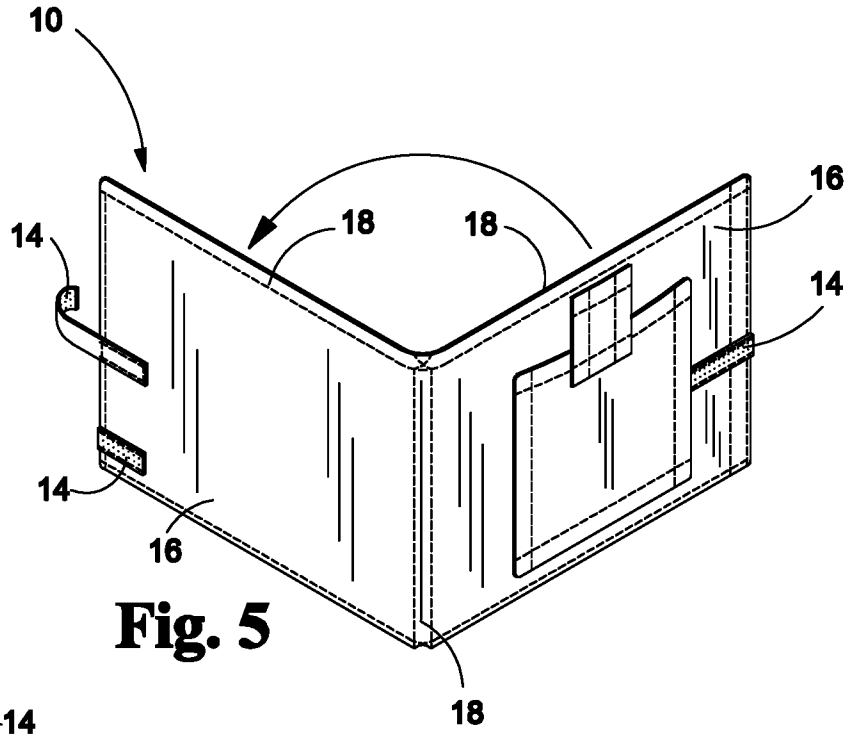
FIG. 5 is a perspective view of an embodiment of the present invention in a partially folded configuration.
Figure 4:
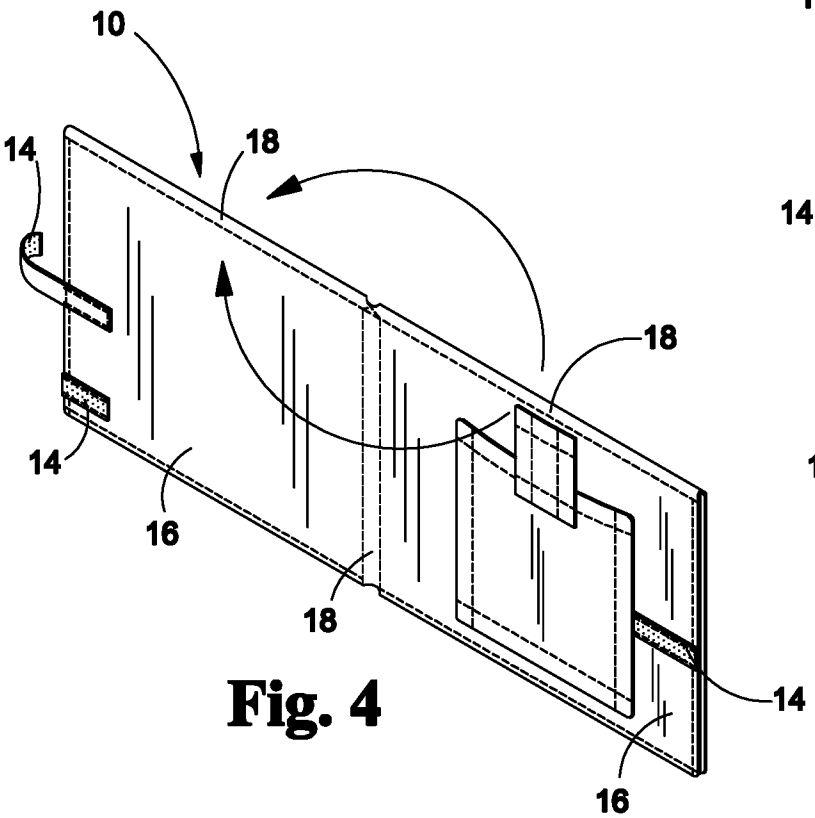
FIG. 4 is a perspective view of an embodiment of the present invention in a partially folded configuration.
Figure 7:
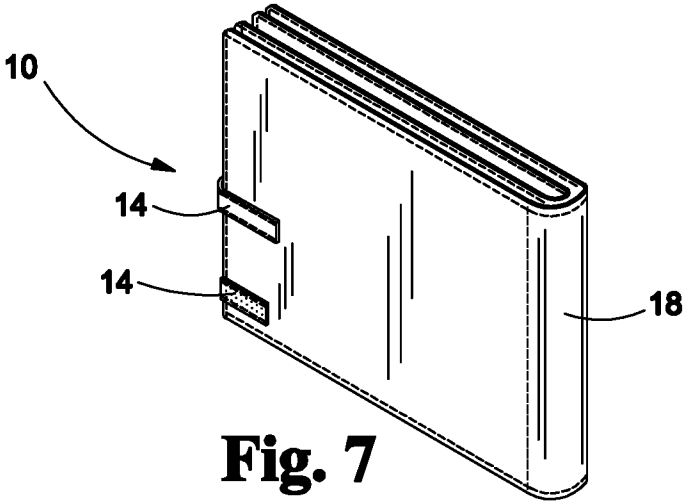
FIG. 7 is a rear perspective view of an embodiment of the present invention in a first folded configuration.
Figure 9:
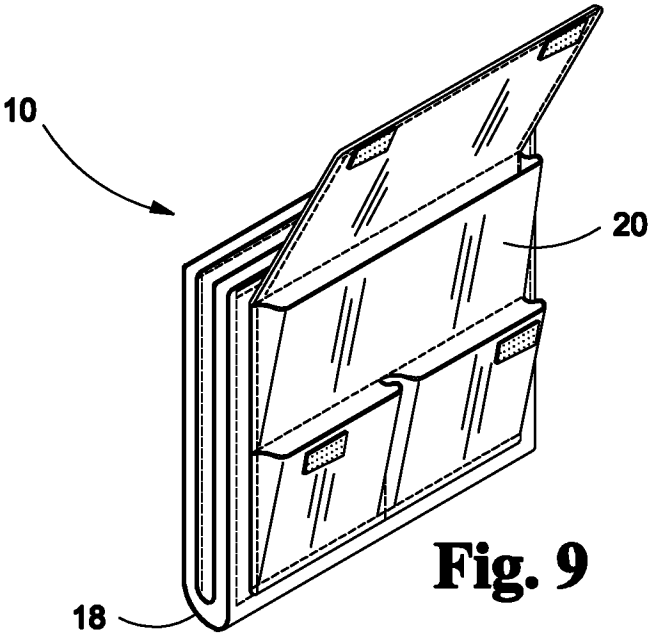
FIG. 9 is a rear perspective view of an embodiment of the present invention in a second folded configuration.
Figure 6:
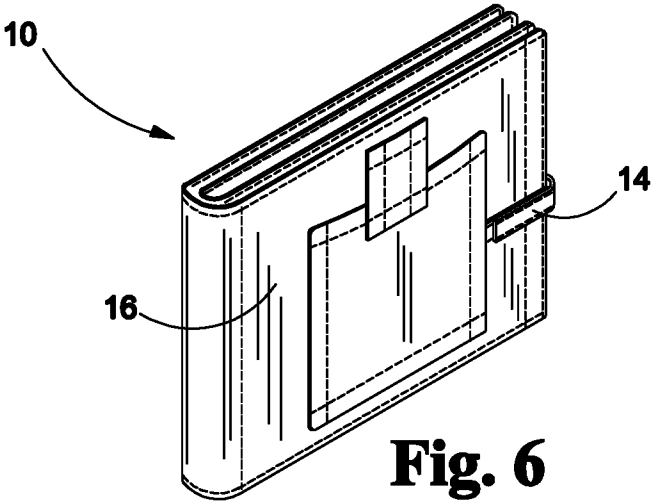
FIG. 6 is a front perspective view of an embodiment of the present invention in a first folded configuration.
Figure 8:
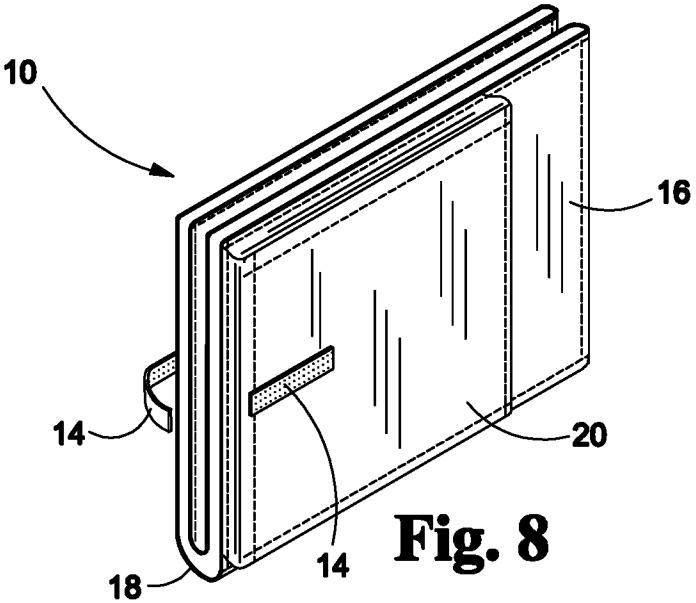
FIG. 8 is a front perspective view of an embodiment of the present invention in a second folded configuration.

Referring to FIGS. 1 through 9, the present invention includes an office supply organizer 10, for providing a compact housing for holding various office supply items in a secure environment. The organizer 10 includes a main body platform 12 substantially having a shape of a quadrangle having four peripheral edges, an underside and a top side. The main body platform 12 further includes four distinct quadrants 16 divided by seams 18. At least one pocket 20 is attached to the top side of at least one of the four adjacent quadrants 16. At least one a closure 14 is coupled to the main body platform 12 and is configured to retain the main body platform 12 in at least one of a first folded configuration and a second folded configuration.

The main body platform 12 may be made of a textile. Each of the four distinct quadrants 16 is comprised of a rigid panel. Each quadrant has four quadrant peripheral edges, each quadrant being adjacent to each other and foldable relative to adjacent quadrants 16 about the seams 18. The main body platform 12 folds along the seams 18 in the first folded configuration and the second folded configuration. The first folded configuration includes the main body platform 12 initially folding inwards towards the top side and then folding again to be one-quarter the dimension of the unfolded main body platform 12. The second folded configuration includes the main body platform 12 initially folding outwards towards the underside and then folding again to be one-quarter the dimension of the unfolded main body platform. The at least one pocket 20 is exposed on an outer surface of the folded main body platform 12 in the second folded configuration.

In certain embodiments, two or more of the quadrants 16 may include pockets 20 coupled to the top side of the main body platform 12. For example, three of the quadrants 16 may include pockets 20 coupled to the top side of the main body platform 12. The pockets 20 may vary in height, depth, and configuration. For example, some pockets 20 may include cover flaps, others may include different types of closures, or no closure at all. The pockets 20 are configured to store different types of office and school supplies, such as papers, electronics, files, folders, writing utensils, notebooks, and the like. The pockets 20 may also be water impermeable to protect electronic devices and papers from getting wet. The last quadrant 16 may include at least one expandable and elastic strap 22 attached to the top side. The strap 22 expands across the top side of the quadrant 16. A second strap 22 may expand across a corner of the quadrant 16. The expandable strap 22 may be used to contain papers, notebooks, files, folders or a tablet device.

As mentioned above, the closure 14 of the present invention is configured to retain the main body platform 12 in at least one of the first folded configuration and the second folded configuration. In certain embodiments, the closure 14 may retain the main body platform 12 in both of the first folded configuration and the second folded configuration. The closure 14 may include hook and loop fasteners, ties, clips, snap buttons, clasps, and the like. In certain embodiments, the closure 14 includes a plurality of hook and loop patches and a hook and loop strap. In such embodiments, three of the four quadrants may include hook and loop patches coupled to the top side. Further one of the four quadrants 16 may include a hook and loop patch on the underside. In either the first folded configuration or the second folded configuration, the hook and loop strap wraps around an edge of the folded main body platform 12 and secures to a hook and loop patch secured to a different quadrant 16, thereby retaining the organizer 10 in a folded configuration.

It should be understood, of course, that the foregoing relates to exemplary embodiments of the invention and that modifications may be made without departing from the spirit and scope of the invention as set forth in the following claims.

What is claimed is:

1. An office supply organizer, for providing a housing for holding various office supply items in a secure environment, comprising:

a main body platform having a shape of a quadrangle having four peripheral edges, an underside and a top side;

at least one closure coupled to the main body platform and configured to retain the main body platform in at least one of a first folded configuration and a second folded configuration, the main body platform further comprising four distinct quadrants divided by seams, each quadrant having four quadrant peripheral edges, each quadrant being adjacent to each other, wherein each quadrant is foldable relative to adjacent quadrants about the seams, the main body platform further comprises at least one pocket attached to a top side of at least one of the four adjacent quadrants, and the main body platform folds along the seams in the first folded configuration and the second folded configuration, wherein the first folded configuration comprises the main body platform initially folding inwards towards the top side and then folding again to be one-quarter a dimension of the unfolded main body platform and the second folded configuration comprises the main body platform initially folding outwards towards the underside and then folding again to be one-quarter the dimension of the unfolded main body platform, wherein the at least one pocket is exposed in the second folded configuration, and wherein at least one of quadrants comprises at least one expandable strap attached to the top side, wherein the strap expands across the top side of the quadrant.

2. The office supply organizer as recited in claim 1, wherein the main body platform is comprised of a textile.

3. The office supply organizer as recited in claim 2, wherein each of the four distinct quadrants is comprised of a rigid panel.

4. The office supply organizer as recited in claim 1, wherein the main body platform further comprises at least one impermeable pocket attached to the top side of at least one of the four adjacent quadrants.

5. The office supply organizer as recited in claim 4, wherein the pocket is expandable.

6. The office supply organizer as recited in claim 1, wherein the impermeable pocket is closable.

7. The office supply organizer as recited in claim 2, wherein the at least one closure is configured to retain the main body platform in the first folded configuration and the second folded configuration.

8. The office supply organizer as recited in claim 7, wherein the closure comprises a plurality of hook and loop patches and a hook and loop strap coupled to the quadrants.

9. The office supply organizer as recited in claim 5, where a carrying handle is attached to the underside of the main body platform.

10. The office supply organizer as recited in claim 1, wherein each strap expands no more than one quadrant, whereby each strap is equally operable along the unfolded main body platform, in the first folded configuration, and in the second folded configuration.

* * * * *